US006774509B2

(12) United States Patent
Chu

(10) Patent No.: US 6,774,509 B2
(45) Date of Patent: Aug. 10, 2004

(54) ELECTRICAL SWITCH ASSEMBLY

(75) Inventor: Raymond Wai Hang Chu, Chai Wan (HK)

(73) Assignee: Defond Manufacturing Limited, Chai Wan (HK)

( * ) Notice: Subject to any disclaimer, the term of this patent is extended or adjusted under 35 U.S.C. 154(b) by 365 days.

(21) Appl. No.: 10/058,766

(22) Filed: Jan. 30, 2002

(65) Prior Publication Data

US 2003/0141765 A1 Jul. 31, 2003

(51) Int. Cl.[7] ..... H01C 10/10

(52) U.S. Cl. ..... 307/112; 174/257; 200/341; 338/215

(58) Field of Search ..... 307/112; 200/341, 200/332.2; 174/260, 257; 338/47, 99, 110, 153, 200, 215

(56) References Cited

U.S. PATENT DOCUMENTS 3,512,429 A * 5/1970 Fresard ..... 338/200
3,567,876 A * 3/1971 Zdanys, Jr. ..... 338/198
3,639,877 A * 2/1972 Fresard et al. ..... 338/153
4,021,699 A * 5/1977 Runtsch ..... 361/11
4,233,479 A * 11/1980 Karpe et al. ..... 200/430
4,286,125 A * 8/1981 Schaffeler et al. ..... 200/6 B
4,549,097 A * 10/1985 Ulmer ..... 200/522
4,608,467 A * 8/1986 Sota ..... 200/16 D
4,649,784 A * 3/1987 Fulks et al. ..... 84/690
4,733,590 A * 3/1988 Watanabe ..... 84/720
4,978,939 A * 12/1990 Zeitvogel ..... 338/176
5,207,697 A * 5/1993 Carusillo et al. ..... 606/167
5,357,062 A * 10/1994 Rockwell et al. ..... 178/18
5,365,155 A * 11/1994 Zimmermann ..... 318/268
5,453,728 A * 9/1995 Zimmermann et al. ..... 338/173
5,455,886 A * 10/1995 Glenn et al. ..... 388/838
5,711,739 A * 1/1998 Hashimoto et al. ..... 475/254
5,892,885 A * 4/1999 Smith et al. ..... 388/809
5,981,885 A * 11/1999 Katoh et al. ..... 200/1 B
6,104,105 A * 8/2000 Schaeffeler et al. ..... 307/125
6,218,633 B1 * 4/2001 Okumura et al. ..... 200/322
6,275,138 B1 * 8/2001 Maeda ..... 338/47

* cited by examiner

*Primary Examiner*—Roberto Jose Rios Cuevas
(74) *Attorney, Agent, or Firm*—Leydig, Voit & Mayer, Ltd.

(57) ABSTRACT

An electrical switch assembly for controlling an electrical appliance, wherein the assembly includes first and second electrical elements. The first element is an on/off switch for initially switching on the appliance. The second element is a pressure-sensitive variable resistor for adjusting the operating condition of the appliance. The variable resistor includes a first part having a resilient deformable and electrically conducting resistive surface and a second part. One of the parts is movable to press against the other part so that their surfaces bear against each other to make an electrical connection between the resistive surface and the element. The resistive surface and the element together provide a resultant resistance between the two contacts that declines as the area of contact increases corresponding to the pressure acting upon the two parts.

32 Claims, 6 Drawing Sheets

ELECTRICAL SWITCH ASSEMBLY

The present invention relates to an electrical switch for controlling the operation of an electrical appliance.

BACKGROUND OF THE INVENTION

The operating condition of certain electrical appliances, such as speed or intensity, can be controlled after the appliance has been switched on. In some cases, it may be necessary or prudent to adjust the operating condition continuously or as required depending on the working situation.

Electrical switch assemblies have been known in general, which include a manual operating member that is arranged for initial movement to switch on an electrical appliance, such as an electric hand drill, and for subsequent movement to adjust the operating condition. Switch assemblies of this type usually incorporate a variable resistor in the control circuit, which is coupled to the operating member for direct control during operation. The variable resistor is typically of the sliding kind, which requires the operating member to have a relatively long operative distance, which may not be suitable for some appliances.

The invention seeks to mitigate or at least alleviate such a shortcoming by providing an improved electrical switch assembly.

SUMMARY OF THE INVENTION

According to the invention, there is provided an electrical switch assembly for controlling the operation of an electrical appliance, which assembly comprises at least first and second electrical elements. The first electrical element comprises an on/off switch for initially switching on said appliance. The second electrical element comprises a pressure-sensitive variable resistor for subsequently adjusting the operating condition of said appliance. The variable resistor comprises a first part having a resilient deformable and electrically conducting resistive surface, and a second part having a surface including at least two contacts and a resistive element connecting from one of said contacts to the other contact. One of the parts is supported for movement to press against the other part such that their surfaces bear against one another, thereby causing the resistive surface to deform against the surface of the second part over an area of contact and causing electrical connection between the resistive surface and the resistive element. The resistive surface and element together then provide a resultant resistance between the two contacts of a value that reduces as said area of contact increases corresponding to the pressure acting upon the two parts.

The assembly includes an operating mechanism for operating the first and second electrical elements, which incorporates manual operating-means arranged for initial movement to operate the on/off switch and subsequent movement, while the on/off switch is on, to operate the variable resistor.

It is preferred that the resistive surface includes fine carbon powder.

It is preferred that the resistive surface has a convex shape facing the surface of the second part of the variable resistor.

Preferably, the first part of the variable resistor comprises a portion made of a resilient deformable and electrically conducting resistive material to provide the resistive surface.

More preferably, the resistive material includes fine carbon powder.

In a specific construction, the first part of the variable resistor comprises a resilient deformable cup-shaped body including a base having an inner side on which the resistive surface is provided.

More specifically, the cup-shaped body includes a substantially frusto-conical peripheral wall that is foldable.

More specifically, the resistive surface includes fine carbon powder.

It is preferred that the resistive element includes fine carbon powder.

It is further preferred that the resistive element comprises a carbon film.

Preferably, said one part is supported for movement to press against the other part in a direction substantially perpendicular to their surfaces.

Preferably, the first part of the variable resistor is supported for movement to press against the second part, and the second part is fixed.

More preferably, the second part of the variable resistor is provided by a portion of a printed circuit board.

The first and second electrical elements may have relatively larger and smaller current ratings respectively.

As an example, the on/off switch comprises a microswitch.

In a first embodiment, the resistive surface and the resistive element are arranged to come into electrical contact with each other when the surfaces of the first and second parts of the variable resistor bear against one another.

In a second embodiment, the resistive surface and said at least two contacts are arranged to come into electrical contact with each other when the said surfaces of the first and second parts of the variable resistor bear against one another.

In the second embodiment, the surface of the second part of the variable resistor includes more than two said contacts arranged close together for electrical contact with the resistive surface, and a corresponding said resistive element connecting across the adjacent contacts of each pair.

Conveniently, the operating mechanism includes a spring resiliently biasing the manual operating means against operating the first and second electrical elements.

In a preferred embodiment, the manual operating means comprises first and second parts for operating the on/off switch and the variable resistor respectively, the first part having a relatively shorter operative length than the second part.

More preferably, the first and second operating parts are separate parts.

It is further preferred that the first and second operating parts are covered by a resiliently deformable sheet element for operation through a single pressing action at the sheet element.

It is further preferred that one of the first and second operating parts has a portion engaging the other operating part for moving the other operating part during operation.

In a specific embodiment, the electrical switch assembly comprises one said on/off switch and two said variable resistors, wherein the manual operating means comprises three separate press members for operating the on/off switch and the two variable resistors respectively.

In this embodiment, the press member for the on/off switch is positioned between the press members for the two variable resistors.

In this embodiment, the press member for one of the variable resistors has a first portion engaging the press member for the on/off switch for simultaneous operation, and the press member for the other variable resistor has a second portion engaging the first portion and in turn the press member for the on/off switch for simultaneous operation.

Also in this embodiment, the two press members for the variable resistors are covered by resiliently deformable sheet means, said means having two regions covering the two press members respectively for individual depression to operate one or both variable resistors.

Further in this embodiment, the sheet comprises a single sheet including a portion that is between the two regions and supported by a fixed member against depression.

The invention also provides an electrical appliance incorporating the aforesaid electrical switch assembly. The appliance comprises a casing in which the switch assembly is located such that the operating mechanism is accessible, an electrical device located in the casing for performing a function of the appliance, and an internal electronic control circuit for controlling the operation of the electrical device. The on/off switch is connected to the electrical device for switching on the electrical device, and the variable resistor is connected to the control circuit for adjusting the operating condition of the electrical device.

Preferably, the casing includes a resiliently deformable wall portion, immediately behind which the operating mechanism is located for operation through depression at the wall portion.

As an example, the electrical device comprises an electric motor.

Conveniently, the casing is elongate and acts a handle.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 2:
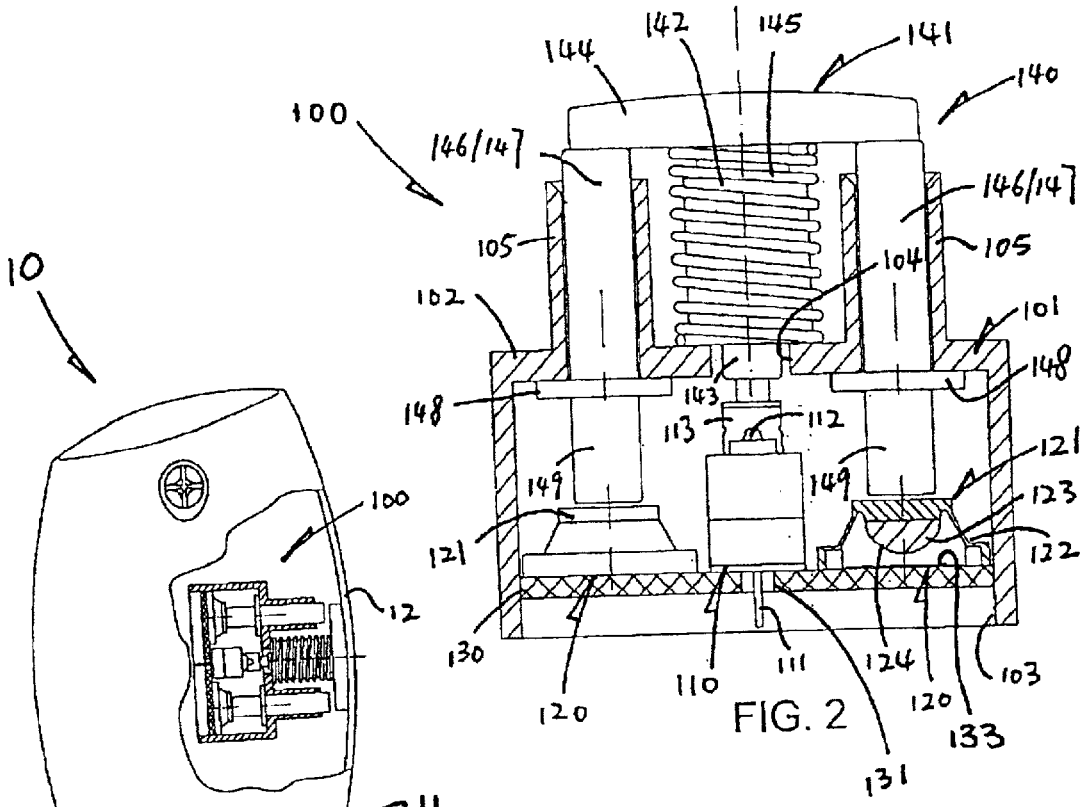
FIG. 2 is a cross-sectional side view of the switch assembly of FIG. 1.
Figure 1:
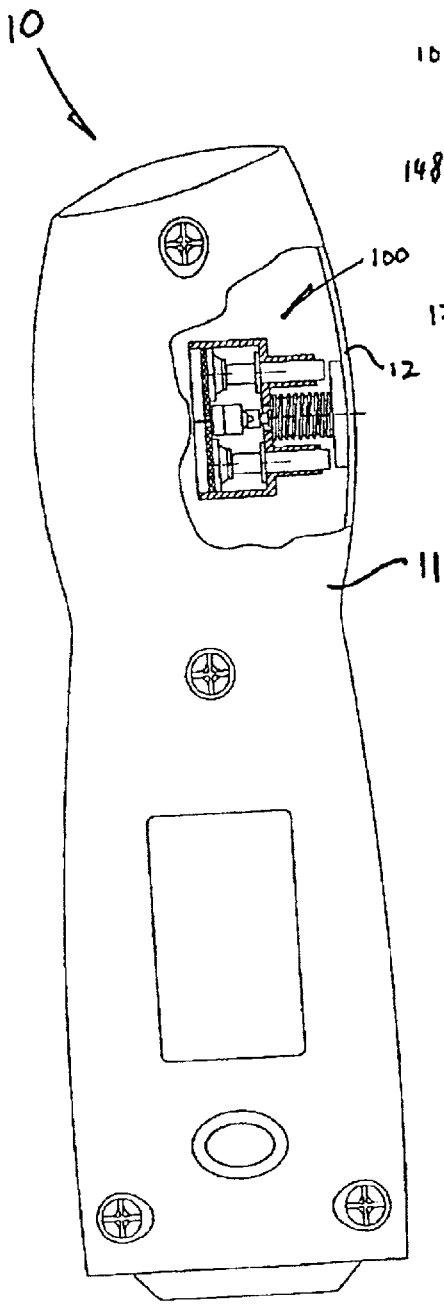
FIG. 1 is a partially cross-sectioned side view of an electrical appliance incorporating a first embodiment of an electrical switch assembly in accordance with the invention.

Referring initially to FIGS. 1 to 8 of the drawings, there is shown a first electrical switch assembly 100 embodying the invention for use in an electrical appliance such as, for example, a hand-held food mixer 10. The food mixer 10 has an upright elongate casing 11 that houses an electrical motor with an associated gearbox and also acts as a handle for gripping by a user. The casing 11 has an upper end including a resiliently deformable wall portion 12 on one side, immediately behind which the switch assembly 100 is located. A mixer implement is to be connected to the lower end of the casing 11 for rotation by the motor via the gearbox.

The switch assembly 100 has a plastic casing 101 which has upper and lower sides/walls 102 and 103. The switch assembly 100 includes a first electrical element 110 in the form of an on/off switch 110 housed at a central position in the casing 101 and a pair of two (at least one) second electrical elements 120 in the form of pressure-sensitive variable resistors 120 housed on opposite left and right sides therein. The three elements 110 and 120 are mounted on a horizontal printed circuit board 130 that extends internally across and closes the lower side 103 of the casing 101. The upper wall 102 of the casing 101 is formed with a central hole 104 and a pair of left and right vertical bush portions 105 upstanding therefrom.

The on/off switch 110 is a micro-switch 110 that has a pair of terminals 111 extending downwardly through respective holes 131 of the circuit board 130. The micro-switch 110 has an internal moving contact electrically connected to one of the terminals 111 for electrical connection to the other terminal 111. The moving contact is supported on a leaf spring which is normally bowed in one direction (against its resilience) and is arranged to momentarily bow in the opposite direction, when it is being pressed upon by means of an external press-knob 112, to connect the two terminals 111. The micro-switch 110 includes an external operating lever 113 to operate the press-knob 112. The construction and operation of the micro-switch 110 are generally known in the art.

Each of the variable resistors 120 comprises a first part in the form of a resiliently deformable rubber cup 121 which has a relatively thin frusto-conical peripheral wall 122 and faces upside down and rests on the circuit board 130. The cup 121 includes a resiliently deformable soft knob 123 located centrally on the inner surface of the upturned base of the cup 121. The knob 123 is made of an electrically conducting but resistive material including carbon powder bonded by a suitable bonding agent, and has a part-spherical convex surface 124. The surface 124 is electrically resistive by nature of the material and faces the circuit board 130, acting as a moving contact.

Each variable resistor 120 includes a second part co-operable with the aforesaid first part, which is provided by a flat portion 125 at each end of the circuit board 130 directly opposite the resistive surface 124. The circuit board portion 125 is provided with a pair of copper contact pads 132 and a elongate (I-shaped) carbon film track 133 that extends across and electrically interconnects the two contact pads 132. The track 133 comprises fine carbon powder bonded by a suitable bonding agent, and has a specific resistance acting as a flat resistive element across the contact pads 132.

The cup 121 of the variable resistor 120 normally expands by virtue of resilience such that its internal resistive surface 124 is spaced apart at a small distance from, or at close proximity to, the resistive track 133 on the circuit board 130. When the cup 121 is compressed downwardly at its upturned base, the peripheral wall 122 will be folded and the resistive surface 124 immediately pressed down into overlapping contact with the resistive track 133 below. As the knob 123 is resiliently deformable, the cup 121 can further be compressed to have the knob surface 124 pressed flat on and bearing against the circuit board 130.

The resistive surface 124 flattens through resilient deformation against the fixed flat resistive track 133, and the area over which they overlap with each other will increase (or decrease) as the pressure acting on them increases (or decreases). While the two resistive surface 124 and track 133 are in contact and overlap with each other, their resultant resistance across the two contact pads 132 will be reduced dependent upon, in a reverse relationship, their area of overlapping contact.

The two pairs of contact pads 132 on the circuit board 130 are connected in series by means of three copper tracks 134 as shown, which results in series connection of the two variable resistors 120.

The switch assembly 100 includes an operating mechanism 140 supported by the casing 101 above and for operating all three electrical elements 110 and 120. The operating mechanism 140 incorporates a central manual operating member 141 for primarily closing the micro-switch 110 and a pair of left and right manual operating members 146 for operating the respective variable resistors 120. The operating members 141 and 146 are horizontally aligned with the corresponding elements 110 and 120 below.

The central operating member 141 has a vertical cylindrical plastic shaft 142 including a reduced lowermost end 143 which is inserted downwardly through the hole 104 into the casing 101 and engages the operating lever 113 of the micro-switch 110. The operating member 141 includes a horizontal plastic top bar 144 that extends integrally across the uppermost end of the shaft 142 to form a T-shape. A compression coil spring 145 is disposed around the shaft 142 and co-acts between the top bar 144 and the casing wall 102 to resiliently bias the overall operating member 141 upwards, such that the micro-switch 110 is normally open.

Each of the left and right operating members 146 consists of a vertical cylindrical plastic rod 147 which passes through, and is thus supported by, the corresponding bush portion 105 for relative sliding movement. The rod 147 has an integral annular flange 148 at mid-length within the casing 101, which retain the rod 147 in the bush portion 105. The flange 148 is positioned such that a lowermost end 149 of the rod 147 is adjacent, or just touching, the cup 121 of the respective variable resistor 120, such that the cup 121 is normally uncompressed. The self-expanding force of the cup 121 is sufficient to overcome the weight of the rod 147 as required, such that the value of the variable resistor 120 is normally the specific resistance of the carbon film track 133 on the circuit board 130.

The top bar 144 of the central operating member 141 extends lengthwise in opposite directions to reach over and engage from above the uppermost ends of the rods 147 of the left and right operating members 146. Upon depression at the top bar 144, the central operating member 141 will slide downwards, which in turn will, simultaneously or instantly afterwards, move both of the side operating members 146 downwards, all against the action of the spring 145. Upon release, the central operating member 141 will slide back upwards under the action of the spring 145, and both side operating members 146 will follow suit under the self-expanding force of the corresponding cups 121 below.

Figure 8:
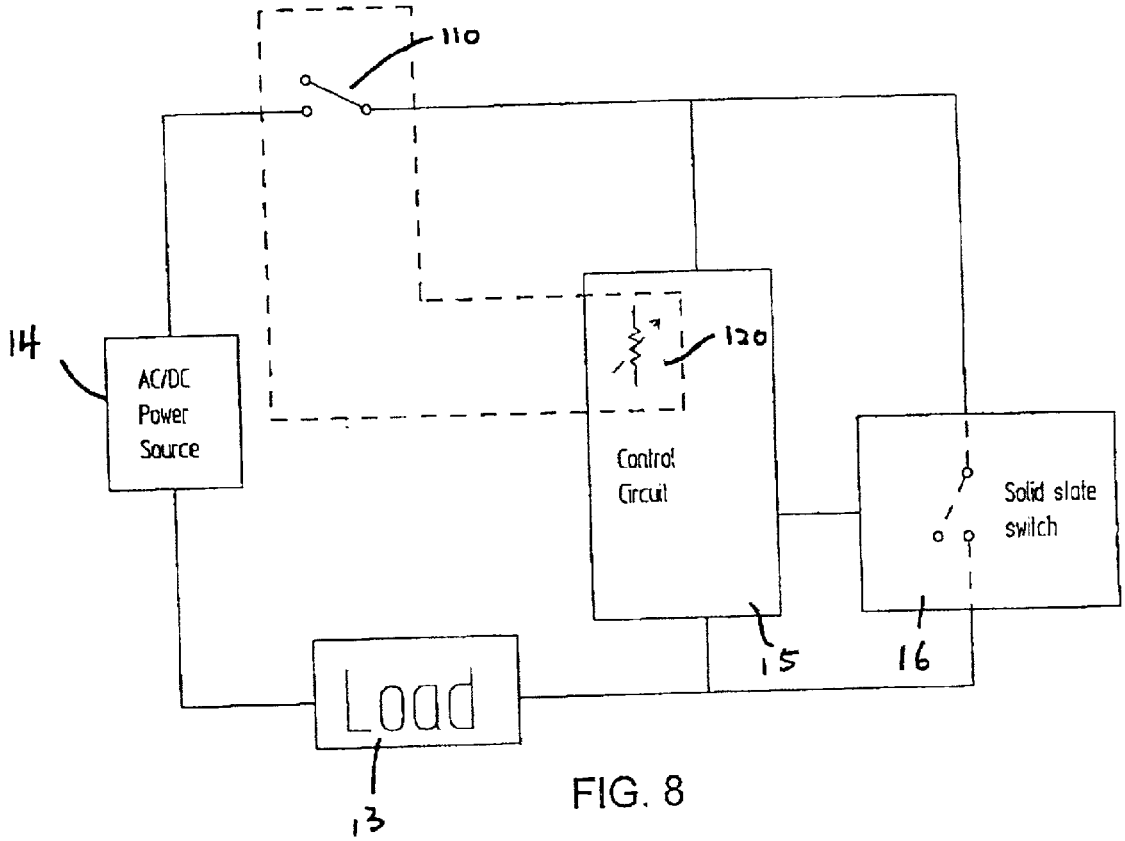
FIG. 8 is an electrical operating circuit of the electrical appliance of FIG. 1.

As shown in FIG. 8, the micro-switch 110 is connected in series with a load 13 i.e. the electric motor of the food mixer 10, and an AC/DC power source 14, for switching on and off the motor. The variable resistors 120 are connected in series together and then to, or form part of, a control circuit 15 that in turn operates a solid-state switch 16, such as a triac or silicon-controlled rectifier, for controlling the speed of the motor. The solid-state switch 16 adjusts the conduction angle of an alternating current in the case of an AC power source, or the duty cycle of a pulsating direct current for a DC power source.

It is necessary for the micro-switch 110 to have a relatively larger current rating in order to handle the load current, whereas the variable resistors 120 are only required to have a relatively small current rating to handle the control current. Although two variable resistors 120 have been included, it is clear that only one can be used instead, depending on the circuit and/or mechanical design, for example the resistance value required in the control circuit 15 and/or physical balance in the switch assembly 100.

The switch assembly 100 is located within the upper end of the casing 11 of the food mixer 10, with its operating bar 144 lying right against the inner surface of the deformable wall portion 12. A user is to depress the wall portion 12 in order to operate the switch assembly 100.

Figure 5A:
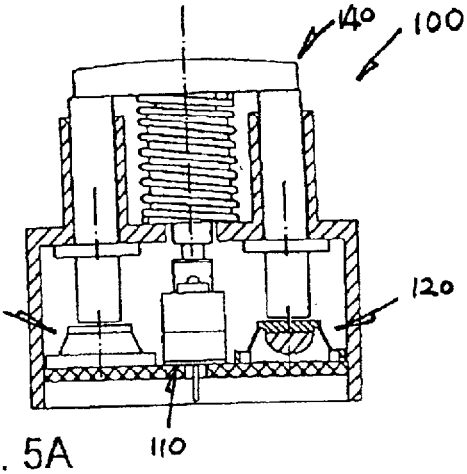
FIGS. 5A and 5B are cross-sectional side view and top plan view corresponding to FIGS. 4A and 4B, showing the switch assembly in an initial switched-on condition.
Figure 4B:
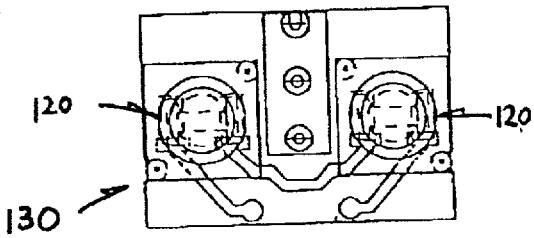
Figure 5B:
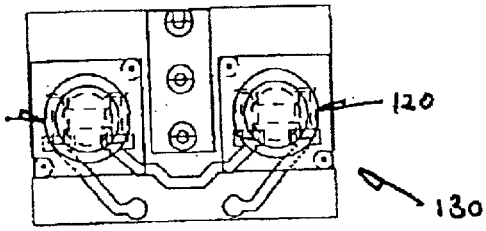
Figure 6A:
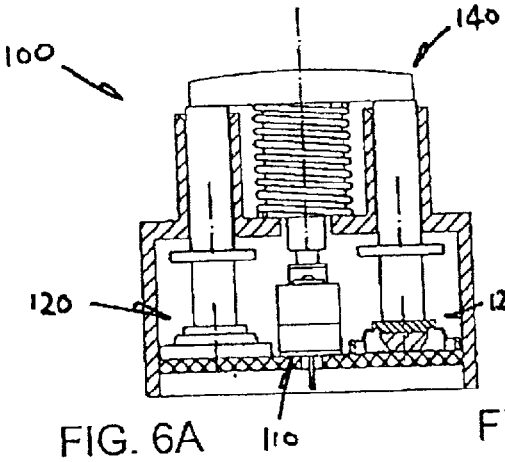
FIGS. 6A and 6B are cross-sectional side view and top plan view corresponding to FIGS. 5A and 5D, showing the switch assembly in an intermediate switched-on condition.
Figure 7A:
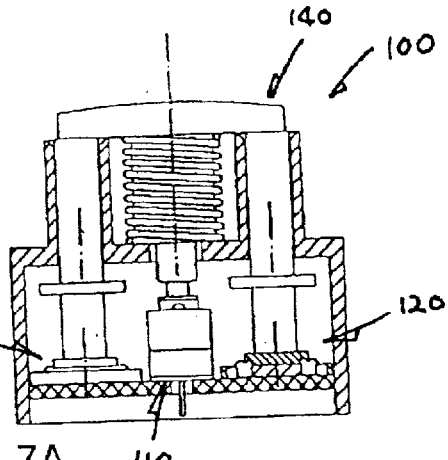
FIGS. 7A and 7B are cross-sectional side view and top plan view corresponding to FIGS. 6A and 6B, showing the switch assembly in a fully switched-on condition.
Figure 6B:
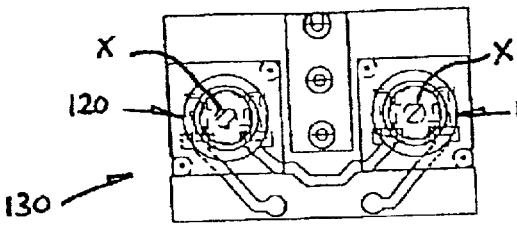
Figure 7B:
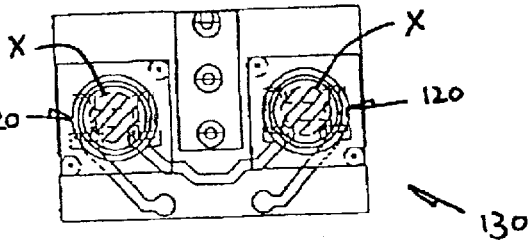

Upon initial depression of the operating bar 144 (FIGS. 4A and 4B), the central operating member 141 will first be pushed inwards to close the micro-switch 110 to switch on the motor (FIGS. 5A and 5B). Upon further depression, the two side operating members 146 will follow and operate the variable resistors 120, while the micro-switch 110 is on, by compressing the corresponding cups 121 in a direction perpendicular to the resistive surfaces 124 and tracks 133. During this action, the resistive surfaces 124 come into initial contact with the corresponding resistive tracks 133 centrally over a relatively small area of contact X (FIGS. 6A and 6B). This results in a reduced resultant resistance in the control circuit 15, and the motor runs at a relatively low speed. Upon further or complete depression, the resistive surfaces 124 will be pressed harder against the corresponding resistive tracks 133 over a gradually larger or the largest possible area X (FIGS. 7A and 7B), thereby resulting in the motor running at a progressively higher or the full speed.

If all three operating members 141 and 146 are arranged to move initially at the same time, their operative lengths, i.e. the distance to travel before actual operation, may be made slightly different such that the central operating member 141 will close the micro-switch 110 first before the two side operating members 146 operate the variable resistors 120.

By nature of the construction, the resistive surfaces 124 of the variable resistors 120 can be spaced apart at a small distance from, or at close proximity to, the corresponding resistive tracks 133 on the circuit board 130. Also, the knobs 123 only need to be compressed slightly to have their resistive surfaces 124 flatten against the circuit board 130. As a result, the operating mechanism 140 can be arranged, as is the case in the described embodiment, to move or travel over a relatively short length, i.e. a rather short operative distance, before it operates all three electrical elements 110 and 120, thereby providing a soft touch feel.

Figure 3:
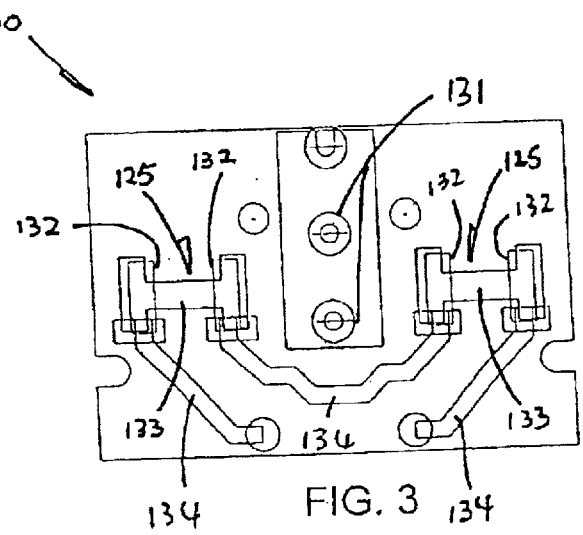
FIG. 3 is a top plan view of a printed circuit board of the switch assembly of FIG. 2.
Figure 3A:
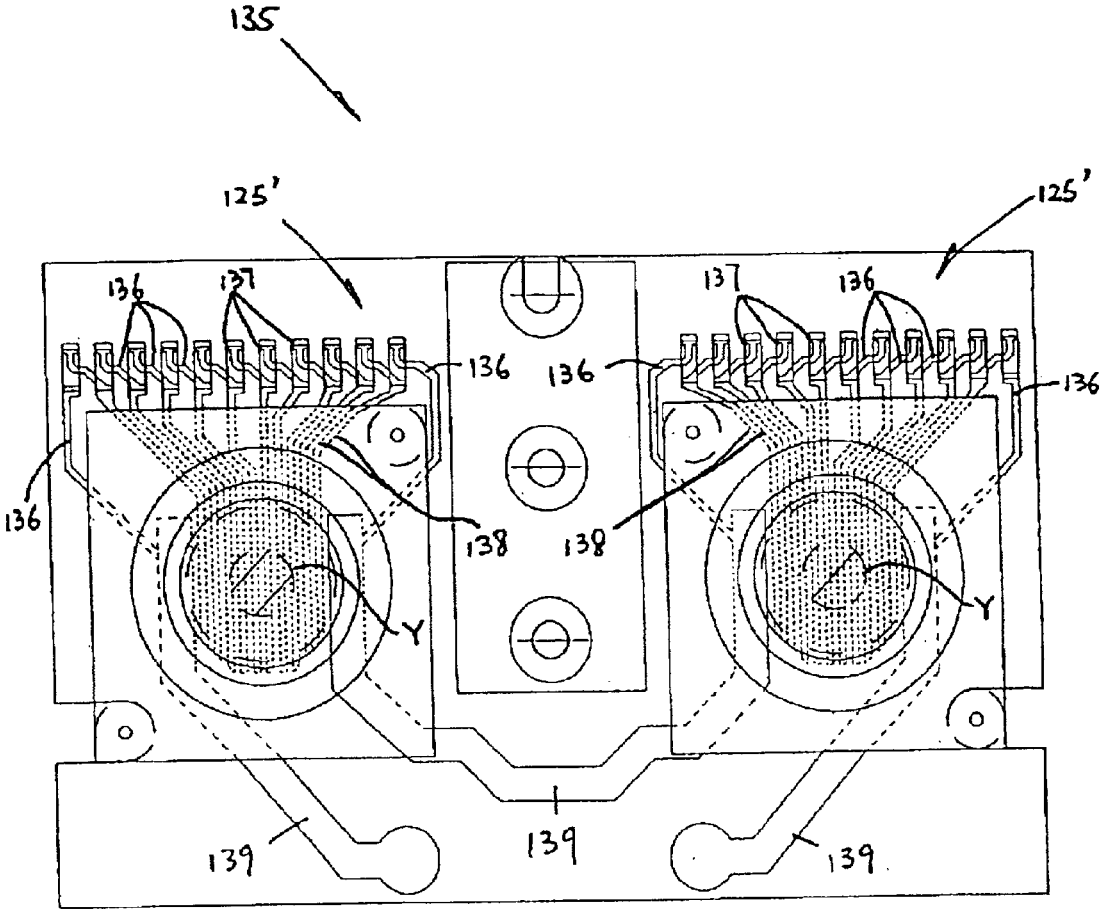
FIG. 3A is a top plan view of an alternative printed circuit board for use in place of the circuit board of FIG. 3.
Figure 4A:
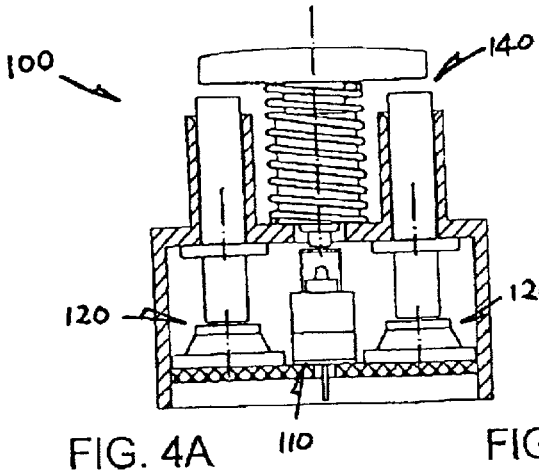
FIGS. 4A and 4B are cross-sectional side view and top plan view corresponding to FIGS. 2 and 3, showing the switch assembly in a switched-off condition.

FIG. 3A shows an alternative printed circuit board 135 for use in place of the circuit board 130 described above. Each end of the circuit board 135 has a flat portion 125' that constitutes the second part of the respective variable resistor 120. The circuit board portion 125' bears twelve mostly slant copper contact pads 136 arranged generally in a row and eleven carbon film resistive elements 137 each of which bridges across and electrically interconnects the adjacent contact pads 136 of a corresponding pair. The copper pads 136 include respective copper tracks 138 which extend to a region directly opposite the resistive surface 124 of the corresponding variable resistor 120, where free ends of the tracks 138 are packed close together but spaced apart in a co-parallel arrangement for contact by the resistive surface 124.

All eleven resistive elements 137 are in effect connected in series, with their ten junctions 136 and the two outermost contact pads 136 at opposite ends extended by means of the corresponding copper tracks 138 to the aforesaid region for contact by the resistive surface 124. The two outermost contact pads 136 constitute a pair of terminals for each variable resistor 120, and the two pairs of terminals are connected by means of three copper tracks 139 as shown such that the two variable resistors 120 are connected in series.

In operation of each variable resistor 120, when the resistive surface 124 comes into initial contact with the copper tracks 138 centrally over a relatively small area of contact Y, the resistive surface 124 overlaps with some (six as shown) of the tracks 138 at the middle. This results in parallel connection of successive portions of the resistive surface 124, by means of the tracks 138 in contact with the resistive surface 124, to the corresponding associated resistive elements 137, such that the resultant resistance across the terminals of the variable resistor 120 is reduced. This causes a reduction in the relevant resistance in the control circuit 15, and the motor runs at a relatively low speed. Upon further depression, the resistive surface 124 will be pressed harder against the tracks 138 over a gradually increasing area such that more and eventually all of the tracks 138 will be connected, thereby resulting in the motor running at a progressively higher and finally the full speed.

It should be note that, with the use of the design of the second circuit board 135, the variable resistors 120 operate like an electrical switch, i.e. closing the open circuit between the copper tracks 138.

Figure 9:
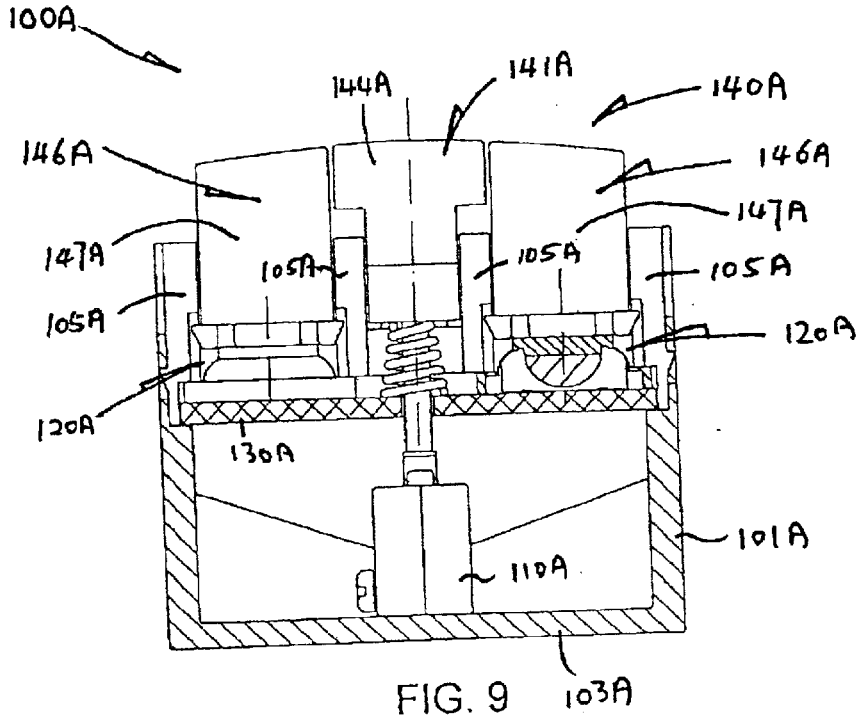
FIG. 9 is a cross-sectional side view of a second embodiment of an electrical switch assembly in accordance with the invention.

Referring next to FIG. 9 of the drawings, there is shown a second electrical switch assembly 100A embodying the invention, whose construction is in part similar to that of the first switch assembly 100, with equivalent parts designated as shown by the same reference numerals suffixed by a letter "A". In the second switch assembly 100A, the central operating member 141A for the micro-switch 110A does not engage with the left and right operating members 146A for the variable resistors 120A.

More specifically, the top part 144A of the central operating member 141A is much shorter across and falls just completely within an upper gap between the two bodies 147A of the side operating members 146A, together forming a combined uppermost surface that is slightly convex. All three operating members 141A and 146A are individually and independently slidable with respect to the casing 101A.

The switch assembly 100A is located such that its said combined uppermost surface lies right against the inner surface of the deformable wall portion 12 of the food mixer 10. Upon depression of the wall portion 12 by a user, although the operating members 141A and 146A are independently slidable, they will be pressed inwards practically at the same time, through a single depressing action, by reason of the wall portion 12 covering and engaging all their uppermost parts.

The operative lengths of the operating members 141A and 146A are made slightly different such that the central operating member 141A will close the micro-switch 110A before the two side operating members 146A operate the variable resistors 120A. The construction and operation of the variable resistors 120A remain the same as that of the previous resistors 120.

Compared with the first switch assembly 100, the second switch assembly 100A includes certain other differences. The bodies of the operating members 141A and 146A are relatively shorter and are supported for vertical sliding movement in individual upright cavities defined by a cradle 105A snap-fitted from above into the casing 101A. The circuit board 130A is located at a relatively higher position in the casing 101A, with the micro-switch 110A located under the circuit board 130A on the casing bottom wall 103A.

Figure 10:
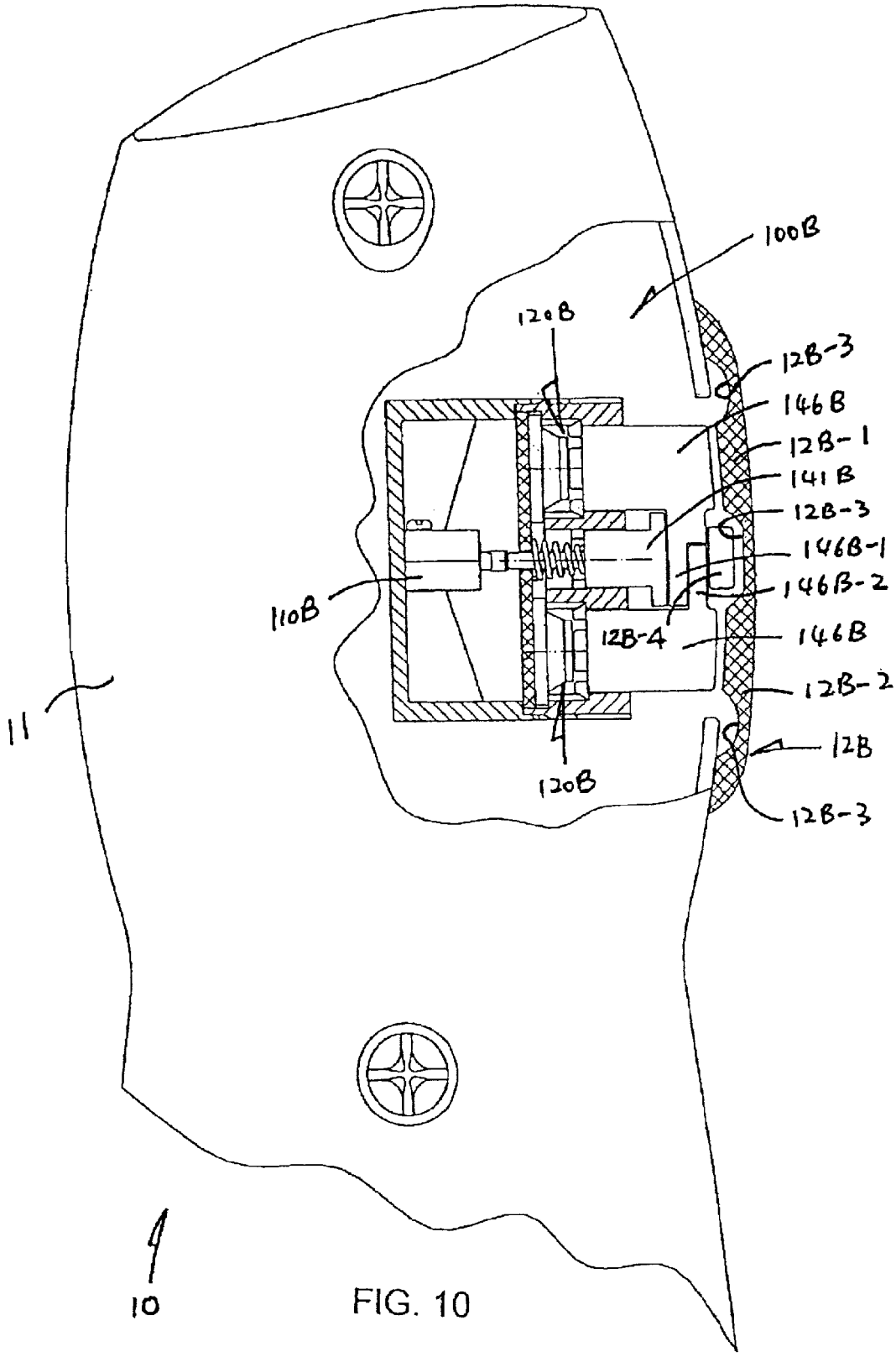
FIG. 10 is a partially cross-sectioned side view of an electrical appliance incorporating a third embodiment of an electrical switch assembly in accordance with the invention.

Referring now to FIG. 10 of the drawings, there is shown a third electrical switch assembly 100B embodying the invention, whose construction is in part similar to the second switch assembly 100A, with equivalent parts designated as shown by the same reference numerals having a different suffix letter "B". In the third switch assembly 100B, the central operating member 141B for the micro-switch 110B is engaged by the left and right operating members 146B for the variable resistors 120B. Similar engaging arrangement is absent from the second switch assembly 100A but can be found, though different, in the first switch assembly 100.

More specifically, the central operating member 141B is much shorter than the two side operating members 146B. The outer end of the left or upper (as shown) operating member 146B has a first arm 146B-1 that extends laterally to reach over and engage from outside the central operating member 141B. The outer end of the right or lower (as shown) operating member 146B has a second arm 146B-2 that extends laterally to reach over and engage from outside the first arm 146B-1 and in turn the central operating member 141B. The central operating member 141B is thus enclosed between the two side operating members 146B by their arms 146B-1 and 146B-2.

The two outer ends of the side operating members 146B together form a combined outermost surface that lies adjacent the inner surface of a rubber cover 12B attached on the side wall at the upper end of the food mixer 10. The cover 12B has upper and lower regions 12B-1 and 12B-2 which are defined by three grooves 12B-3 in the inner surface of the cover 12B and cover the outer ends of the upper and lower operating members 146B respectively. Due to the presence of the grooves 12B-3, together with a fixed bar 12B-4 engaged by the middle groove 12B-3 (between the two regions 12B-1 and 12B-2) and acting as a support against depression, the two cover regions 12B-1 and 12B-2 can readily and individually be pressed inwards.

Upon depression of the lower region 12B-2 of the cover 12B, the central operating member 141B and both the two side operating members 146B will be simultaneously pressed inwards, by reason of the aforesaid engagement of the second arm 146B-2 upon the first arm 146B-1 and in turn upon the central operating member 141B. This will result in closing of the micro-switch 110B and then operation of both variable resistors 120B while the micro-switch 110B is on, as described above. As both variable resistors 120B come into operation to reduce the relevant resistance in the control circuit 15, the motor can run at a speed in the full range, depending on how hard the cover region 12B-2 is depressed.

On the other hand, depression of the upper cover region 12B-1 will cause the central operating member 141B and only the upper operating member 146B to be simultaneously pressed inwards, by reason of the aforesaid engagement of the first arm 146B-1 upon the central operating member 141B. This will result in closing of the micro-switch 110B and then operation of the upper variable resistor 120B while the micro-switch 110B is on. As only one of the two variable resistors 120B comes into operation reducing the relevant resistance in the control circuit 15 to a lesser extent, the motor can only run at a speed in the lower range, depending on how hard the cover region 12B-1 is depressed.

Figure 11:
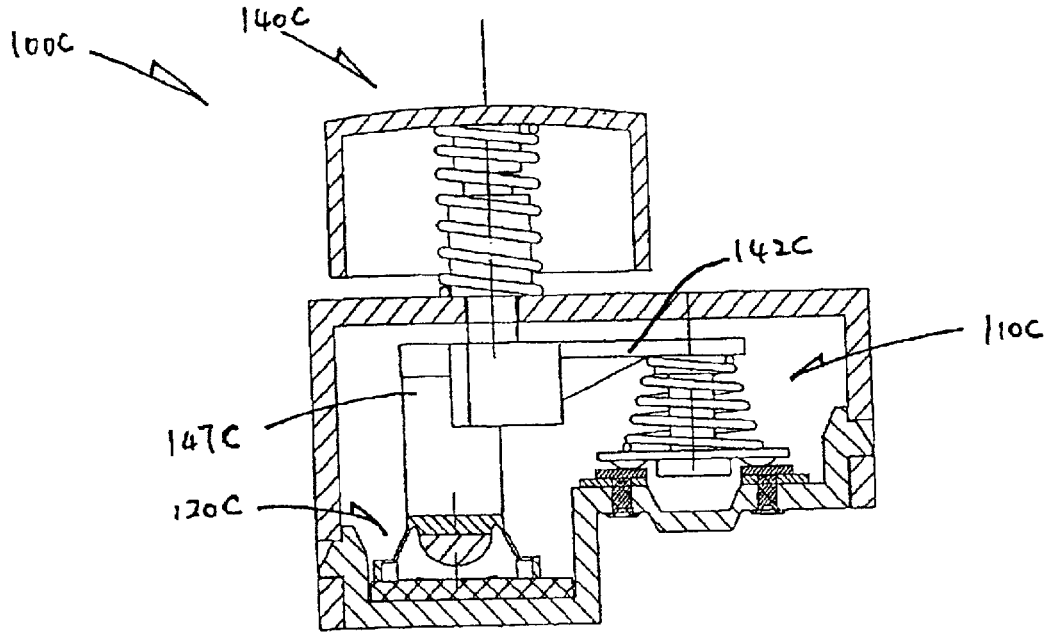
FIG. 11 is a cross-sectional side view of another embodiment of an electrical switch assembly in accordance with the invention.
Figure 12:
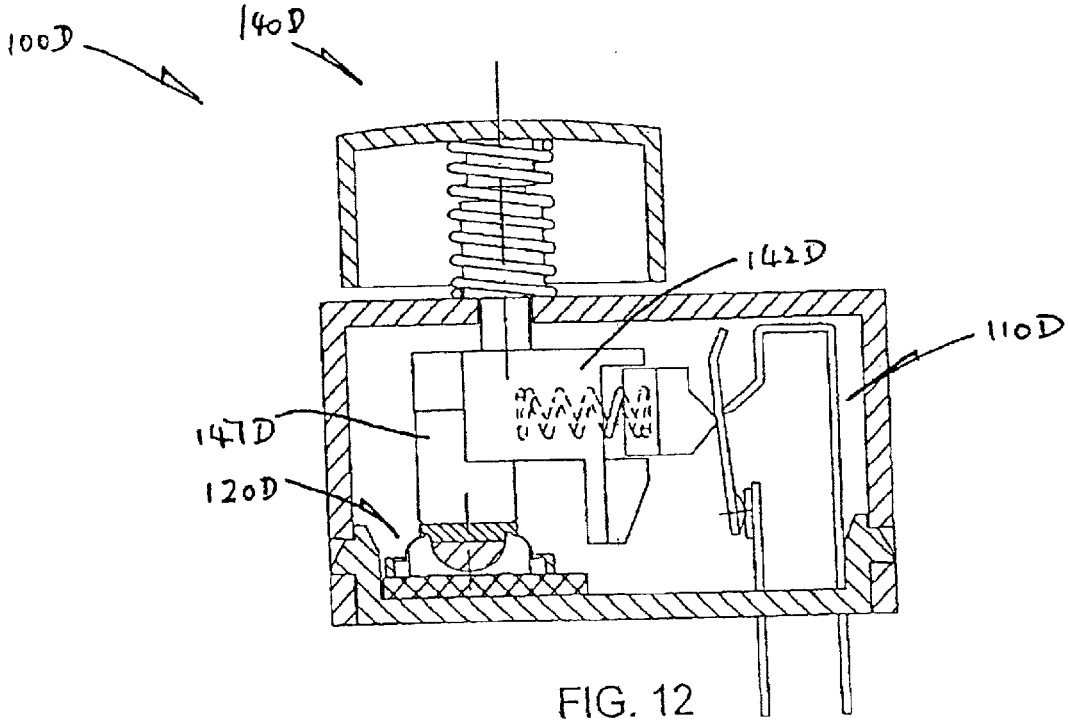
FIG. 12 is a cross-sectional side view of yet another embodiment of an electrical switch assembly in accordance with the invention.

Reference is finally made to FIGS. 11 and 12, which show two further electrical switch assemblies 100C and 100D embodying the invention, both sharing the same basic concept as the three earlier embodiments 100/100A/100B, comprising an on/off switch 110C/D and at least one pressure-sensitive variable resistor 120C/D. Each assembly 100C/D includes an operating mechanism 140C/D supported for initial movement to close the on/off switch 110C/D and for subsequent movement, while the switch 110C/D is on, to adjust the resistance of the variable resistor 120C/D. The operating mechanism 140C/D includes first and second parts 142C/D and 147C/D for operating the switch 110C/D and variable resistor 120C/D respectively, in which the first part 142C/D has a relatively shorter operative length compared with the second part 147C/D.

The variable resistor 120C/D has the same construction as that of the three earlier variable resistors 120/120A/120B and operates in the same manner, but the on/off switch 110C/D is not a micro-switch. One switch 110C is a press-button switch that includes a pair of fixed contacts and a moving contact arranged to short-circuit the fixed contacts. The other switch 110D is a rocker switch including a fixed contact and a moving contact that is pivotable about a fulcrum and acted upon by a spring-loaded slider on the rear side. The slider rocks, while riding across opposite sides of the fulcrum, the moving contact into or out of contact with the fixed contact.

It should be understood that the subject switch assembly is not limited to the use in electrical appliances that incorporate an electric motor, and can be used in all types of electrical appliances as appropriate, including a torch or flashlight for example.

The invention has been given by way of example only, and various other modifications of and/or alterations to the described embodiments may be made by persons skilled in the art without departing from the scope of the invention as specified in the appended claims.

What is claimed is:

1. An electrical switch assembly for controlling operation of an electrical appliance, the switch comprising:

first and second electrical elements, the first electrical element comprising an on/off switch for initially switching on an appliance, the second electrical element comprising a pressure-sensitive variable resistor for adjusting operating condition of the appliance, the variable resistor comprising a first part having a resilient deformable and electrically conducting resistive surface and a second part having a surface including two contacts and a resistive element connecting one of the contacts to the other of the contacts, one of the first and second parts being moved to press against the other of the first and second parts such that respective surfaces of the first and second parts bear against one another, thereby causing the resistive surface to deform against the surface of the second part over an area of contact and causing electrical connection between the resistive surface and the resistive element, to provide a resultant resistance between the two contacts that declines as the area of contact increases, corresponding to pressure applied to the first and second parts, and an operating mechanism operating the first and second electrical elements and incorporating manual operating means for initial movement to operate the on/off switch and subsequent movement, while the on/off switch is on, to change the resultant resistance of the variable resistor.

2. The electrical switch assembly as claimed in claim 1, wherein the resistive surface includes fine carbon powder.

3. The electrical switch assembly as claimed in claim 1, wherein the resistive surf ace has a convex shape facing the surface of the second part of the variable resistor.

4. The electrical switch assembly as claimed in claim 1, wherein the first part of the variable resistor comprises a portion of a resilient deformable and electrically conducting resistive material as the resistive surface.

5. The electrical switch assembly as claimed in claim 4, wherein the resistive material includes fine carbon powder.

6. The electrical switch assembly as claimed in claim 1, wherein the first part of the variable resistor comprises a resilient deformable cup-shaped body including a base having an inner side on which the resistive surface is located.

7. The electrical switch assembly as claimed in claim 6, wherein the cup-shaped body includes a substantially frusto-conical peripheral wall.

8. The electrical switch assembly as claimed in claim 6, wherein the resistive surface includes fine carbon powder.

9. The electrical switch assembly as claimed in claim 1, wherein the resistive element includes fine carbon powder.

10. The electrical switch assembly as claimed in claim 9, wherein the resistive element comprises a carbon film.

11. The electrical switch assembly as claimed in claim 1, wherein the one of the first and second parts that is movable moves to press against the other of the first and second parts in a direction substantially perpendicular to the respective surfaces of the first and second parts.

12. The electrical switch assembly as claimed in claim 1, wherein the first part of the variable resistor is movable and the second part is fixed.

13. The electrical switch assembly as claimed in claim 12, wherein the second part includes a printed circuit board.

14. The electrical switch assembly as claimed in claim 1, wherein the first and second electrical elements have relatively larger and smaller current ratings, respectively.

15. The electrical switch assembly as claimed in claim 1, wherein the on/off switch comprises a micro-switch.

16. The electrical switch assembly as claimed in claim 1, wherein the resistive surface and the resistive element are brought into electrical contact with each other when the respective surfaces of the first and second parts of the variable resistor bear against one another.

17. The electrical switch assembly as claimed in claim 1, wherein the resistive surface and the two contacts are brought into electrical contact with each other when the respective surfaces of the first and second parts of the variable resistor bear against one another.

18. The electrical switch assembly as claimed in claim 17, wherein the surface of the second part of the variable resistor includes more than two contacts for electrical contact with the resistive surface, and a corresponding resistive element connecting adjacent contacts.

19. The electrical switch assembly as claimed in claim 1, wherein the operating mechanism includes a spring resiliently biasing the manual operating means against operation of the first and second electrical elements.

20. The electrical switch assembly as claimed in claim 1, wherein the manual operating means comprises third and fourth parts for operating the on/off switch and the variable resistor respectively, the third part having a shorter operative length than the fourth part.

21. The electrical switch assembly as claimed in claim 20, wherein the third and fourth operating parts are separate.

22. The electrical switch assembly as claimed in claim 21, including a resiliently deformable sheet element covering the third and fourth operating parts for operation by pressing against the sheet element.

23. The electrical switch assembly as claimed in claim 21, wherein one of the third and fourth operating parts has a portion engaging the other of the third and fourth operating part for moving the other of the third and fourth operating parts.

24. The electrical switch assembly as claimed in claim 1, comprising two variable resistors, wherein the manual operating means comprises three separate members for operating the on/off switch and the two variable resistors, respectively.

25. The electrical switch assembly as claimed in claim 24, wherein the member for operating the on/off switch is positioned between the members for operating the two variable resistors.

26. The electrical switch assembly as claimed in claim 24, wherein the member for operating a first one of the variable resistors has a first portion engaging the member member for a second of the variable resistors has a second portion engaging the first portion for simultaneous operation of the on/off switch.

27. The electrical switch assembly as claimed in claim 26, including a resiliently deformable sheet means covering the two members for operating the variable resistors, said resiliently deformable sheet means having two regions covering the two members, respectively, for individual depression to operate the variable resistors.

28. The electrical switch assembly as claimed in claim 27, wherein the sheet means comprises a single sheet including a portion between the two regions and a fixed member supporting the portion against depression.

29. An electrical appliance incorporating the electrical switch assembly as claimed in claim 1, the appliance comprising a casing in which the switch assembly is located, an electrical device located in the casing, and an internal electronic control circuit for controlling operation of the electrical device, wherein the on/off switch is connected to the electrical device for switching on the electrical device, and the variable resistor is connected to the control circuit for adjusting an operating condition of the electrical device.

30. The electrical appliance as claimed in claim 29, wherein the casing includes a resiliently deformable wall portion, adjacent the operating mechanism for operation through depression of the resiliently deformable wall portion.

31. The electrical appliance as claimed in claim 29, wherein the electrical device comprises an electric motor.

32. The electrical appliance as claimed in claim 29, wherein the casing is an elongate handle.

* * * * *